US006003914A

United States Patent [19]

Brisbin

[11] Patent Number: 6,003,914

[45] Date of Patent: Dec. 21, 1999

[54] PACKING COTTON REMOVAL TOOL

[76] Inventor: Cynthia L. Brisbin, 3027 2nd Ave. North, Texas City, Tex. 77590

[21] Appl. No.: 09/238,597

[22] Filed: Jan. 28, 1999

[51] Int. Cl.[6] ..... B25B 9/00

[52] U.S. Cl. ..... 294/26; 294/61; 29/278

[58] Field of Search ..... 294/1.1, 3.6, 25, 294/26, 61; 81/3.48, 3.49, 487, 488; 29/270, 278; 30/113.1

[56] References Cited

U.S. PATENT DOCUMENTS

| | | | |
|---|---|---|---|
| 827,246 | 7/1906 | Livingston | 294/26 |
| 1,082,516 | 12/1913 | Griffith | 294/61 |
| 1,328,964 | 1/1920 | Penn | 294/26 |
| 2,461,941 | 2/1949 | Sutton | 294/26 |
| 3,385,625 | 5/1968 | Heines | 294/26 |
| 4,899,050 | 2/1990 | Cianflone | 294/19.1 |
| 4,944,081 | 7/1990 | Ross | 294/61 |

FOREIGN PATENT DOCUMENTS

| | | | |
|---|---|---|---|
| 929819 | 1/1948 | France | 81/3.49 |
| 343723 | 2/1931 | United Kingdom | 294/61 |

*Primary Examiner*—Dean J. Kramer

[57] ABSTRACT

A packing cotton removal tool for removing packing cotton from a container such as a medicine or vitamin bottle. The packing cotton removal tool includes a shaft with opposite proximal and distal ends. The shaft has a hook at the distal end of the shaft. A finger tab is coupled to proximal end of the shaft such that the distal end of the shaft outwardly extends away from the tab.

8 Claims, 2 Drawing Sheets

PACKING COTTON REMOVAL TOOL

BACKGROUND OF THE INVENTION

1. Field of the Invention

The present invention relates to devices for removing packing cotton from containers and more particularly pertains to a new packing cotton removal tool for removing packing cotton from a container such as a medicine or vitamin bottle.

2. Description of the Prior Art

The use of devices for removing packing cotton from containers is known in the prior art. More specifically, devices for removing packing cotton from containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,706,154 by Luebbers et al.; U.S. Pat. No. 2,372,743 by Schofield et al; U.S. Pat. No. Des. 280,463 by Sheahan; U.S. Pat. No. 4,739,573 by Robertson; U.S. Pat. No. 4,955,647 by Alfredson; and U.S. Pat. No. 2,586,245 by McRae.

While these devices fulfill their respective, particular objectives and requirements, the aforementioned patents do not disclose a new packing cotton removal tool. The inventive device includes a shaft with opposite proximal and distal ends. The shaft has a hook at the distal end of the shaft. A finger tab is coupled to proximal end of the shaft such that the distal end of the shaft outwardly extends away from the tab.

In these respects, the packing cotton removal tool according to the present invention substantially departs from the conventional concepts and designs of the prior art, and in so doing provides an apparatus primarily developed for the purpose of removing packing cotton from a container such as a medicine or vitamin bottle.

SUMMARY OF THE INVENTION

In view of the foregoing disadvantages inherent in the known types of devices for removing packing cotton from containers now present in the prior art, the present invention provides a new packing cotton removal tool construction wherein the same can be utilized for removing packing cotton from a container such as a medicine or vitamin bottle.

The general purpose of the present invention, which will be described subsequently in greater detail, is to provide a new packing cotton removal tool apparatus and method which has many of the advantages of the devices for removing packing cotton from containers mentioned heretofore and many novel features that result in a new packing cotton removal tool which is not anticipated, rendered obvious, suggested, or even implied by any of the prior art devices for removing packing cotton from containers, either alone or in any combination thereof.

To attain this, the present invention generally comprises a shaft with opposite proximal and distal ends. The shaft has a hook at the distal end of the shaft. A finger tab is coupled to proximal end of the shaft such that the distal end of the shaft outwardly extends away from the tab.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new packing cotton removal tool apparatus and method which has many of the advantages of the devices for removing packing cotton from containers mentioned heretofore and many novel features that result in a new packing cotton removal tool which is not anticipated, rendered obvious, suggested, or even implied by any of the prior art devices for removing packing cotton from containers, either alone or in any combination thereof.

It is another object of the present invention to provide a new packing cotton removal tool which may be easily and efficiently manufactured and marketed.

It is a further object of the present invention to provide a new packing cotton removal tool which is of a durable and reliable construction.

An even further object of the present invention is to provide a new packing cotton removal tool which is susceptible of a low cost of manufacture with regard to both materials and labor, and which accordingly is then susceptible of low prices of sale to the consuming public, thereby making such packing cotton removal tool economically available to the buying public.

Still yet another object of the present invention is to provide a new packing cotton removal tool which provides in the apparatuses and methods of the prior art some of the advantages thereof, while simultaneously overcoming some of the disadvantages normally associated therewith.

Still another object of the present invention is to provide a new packing cotton removal tool for removing packing cotton from a container such as a medicine or vitamin bottle.

Yet another object of the present invention is to provide a new packing cotton removal tool which includes a shaft with opposite proximal and distal ends. The shaft has a hook at the distal end of the shaft. A finger tab is coupled to proximal end of the shaft such that the distal end of the shaft outwardly extends away from the tab.

Still yet another object of the present invention is to provide a new packing cotton removal tool that can quickly remove packing cotton from long necked or small necked bottles and when the packing cotton is tightly packed in the bottle. This tool thereby eliminates the need to a user to spend time trying to remove packing cotton from a bottle with their fingers.

Even still another object of the present invention is to provide a new packing cotton removal tool that is small and compact for easy storage when not in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
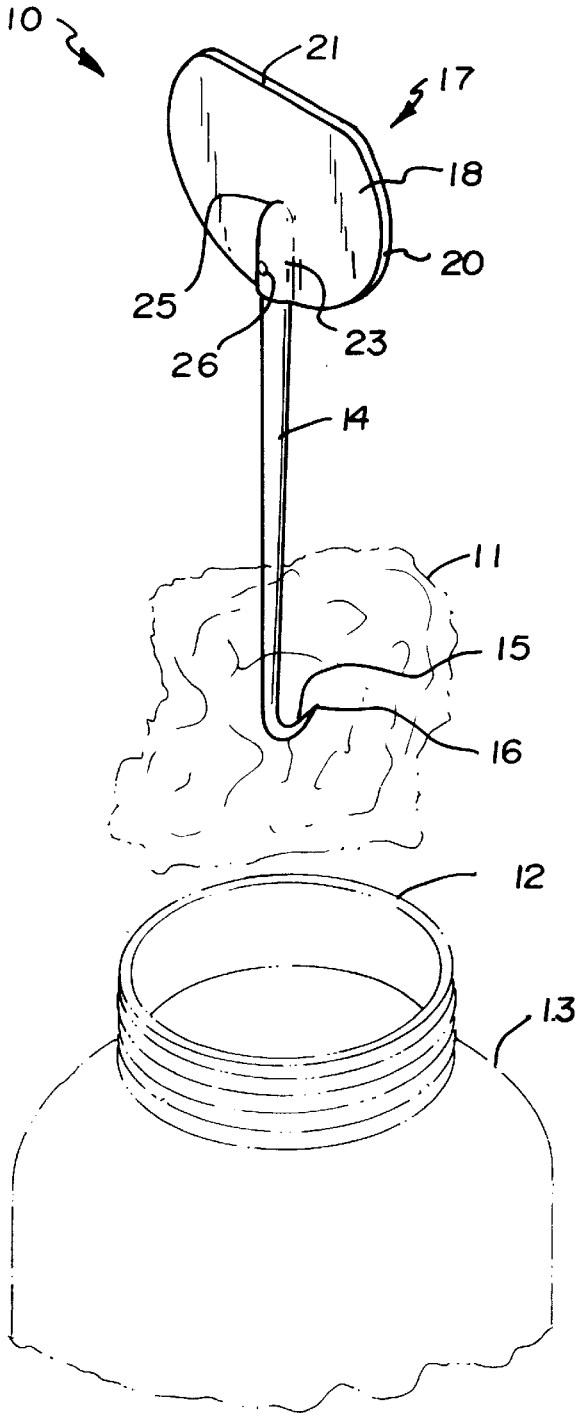
FIG. 1 is a schematic perspective view of a new packing cotton removal tool in use removing a wad of packing cotton from the mouth of a bottle according to the present invention.

With reference now to the drawings, and in particular to FIGS. 1 through 4 thereof, a new packing cotton removal tool embodying the principles and concepts of the present invention and generally designated by the reference numeral 10 will be described.

As best illustrated in FIGS. 1 through 4, the packing cotton removal tool 10 generally comprises a shaft with opposite proximal and distal ends. The shaft has a hook at the distal end of the shaft. A finger tab is coupled to proximal end of the shaft such that the distal end of the shaft outwardly extends away from the tab.

In use, as illustrated in FIG. 1, the packing cotton removal tool 10 is designed for removing packing cotton 11 from a mouth 12 of a container 13 such as a medicine or vitamin bottle used to hold pills and tablets therein.

Figure 2:
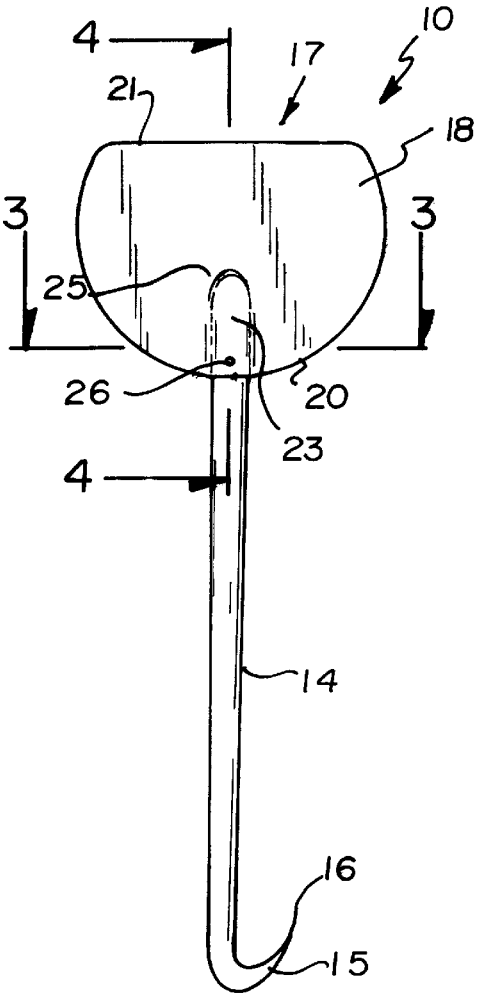
FIG. 2 is a schematic side view of the present invention.
Figure 3:
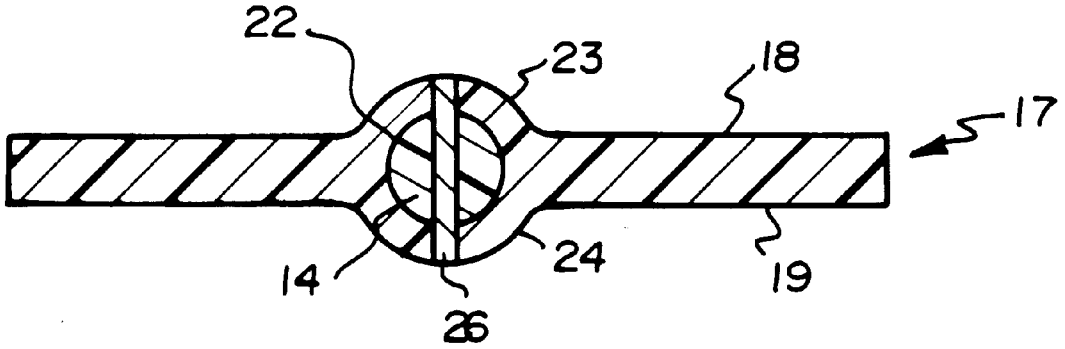
FIG. 3 is a schematic cross sectional view of the present invention taken from line 3—3 of FIG. 2.

In closer detail, the tool comprises an elongate shaft 14 having opposite proximal and distal ends, and a longitudinal axis extending between the proximal and distal ends of the shaft. As best illustrated in FIG. 3, the shaft has a generally circular transverse cross section taken in a plane substantially perpendicular to the longitudinal axis of the shaft. The shaft has a length defined between the ends of the shaft and a diameter defined substantially perpendicular to the longitudinal axis of the shaft. Preferably, the shaft tapers from the proximal end of the shaft to the distal end of the shaft, as best shown in FIG. 2, such that the diameter of the shaft is greater at the proximal end of the shaft than at the distal end of the shaft. In an ideal illustrative embodiment, the length of the shaft is about 2½ inches, and the diameter of the shaft at the distal end of the shaft is about 1/16 inch.

The shaft has a hook 15 at the distal end of the shaft. The hook tapers to a pointed tip 16 adapted for insertion into a wad of packing cotton. In use, the distal end of the shaft is designed for insertion into a mouth of a container such as a bottle such that the hook hooks into packing cotton in the container so that pulling out of the distal end from the container pulls the packing cotton out of the container with the hook.

The tool also includes a finger tab 17 having a pair of substantially planar and parallel faces 18, 19, and an outer perimeter comprises an arcuate edge 20, and a straight edge 21. In use, the tab is designed for grasping between a user's fingers to hold the tool and to permit manipulation of the hook on the shaft when inserting and removing the shaft from the container.

Preferably, the arcuate edge of the tab defines an arc greater than a semi-circle and less than a full circle. Even more preferably, the arc of the arcuate edge defines an angle and radius of curvature with the angle of curvature of the arc between about 180 degrees and about 270 degrees.

The tab has a thickness defined between the faces of the tab and a width defined across the arcuate edge of the tab substantially parallel to the straight edge of the tab. In an ideal illustrative embodiment, the thickness of the tab is about 1/16 inch and the width of the tab is about 1½ inches. In this ideal embodiment, the straight edge of the tab ideally has a length of about 1 inch so that the width of the tab is greater than the length of the straight edge.

Figure 4:
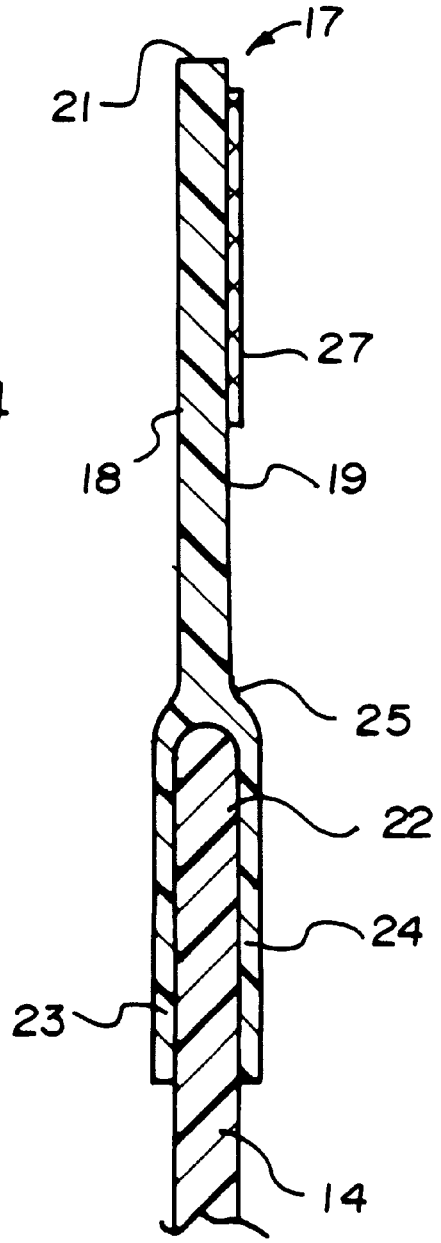
FIG. 4 is a schematic cross sectional view of the present invention taken from line 4—4 of FIG. 2.

As best shown in FIGS. 3 and 4, the arcuate edge of the tab has generally cylindrical bore 22 into the tab located opposite the straight edge of the tab. The bore of the tab preferably has an axis extending substantially perpendicular to the straight edge of the tab. Preferably, the tab has a generally cylindrical thickened region about the bore. The thickened region of the tab has a generally semi-cylindrical first portion 23 outwardly extending from one of the faces tab and a generally semi-cylindrical second portion 24 outwardly extending from the other face of the tab. Also preferably, the thickened region of the tab has a rounded end 25 opposite the arcuate edge of the tab to prevent injury thereby to the fingers of a user grasping the tab.

The proximal end of the shaft is inserted into the bore of the tab such that the distal end of the shaft outwardly extends away from the arcuate edge of the tab. Preferably, the longitudinal axis of the shaft is extended substantially perpendicular to the straight edge of the tab. Ideally, the hook of the shaft lies in a plane extending generally parallel to the planes of the faces of the tab.

A pin 26 is preferably extended into the thickened region of the tab through the bore of the tab and a portion of the shaft inserted into the bore of the tab. The pin secures the distal end of the shaft in the bore of the tab. As best illustrated in FIG. 3, the pin has a longitudinal axis extending substantially perpendicular to the longitudinal axis of the shaft.

Ideally, the tab has a magnet 27 coupled to one of the faces of the tab between the rounded end of the thickened region and the straight edge. In use, the magnet is designed for magnetically attaching the tab to a magnetizable metal surface such as the exterior surface of a fridge. The magnet is preferably generally rectangular and, in the ideal illustrative embodiment, has dimensions of a length of about 1 inch and a width of about ½ inch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool for removing packing cotton from a container, said tool comprising:

a shaft having opposite proximal and distal ends;

said shaft having a hook at said distal end of said shaft;

a tab being coupled to proximal end of said shaft such that said distal end of said shaft outwardly extends away from said tab;

wherein said tab has a pair of faces, and an outer perimeter comprising an arcuate edge and a straight edge, wherein said arcuate edge of said tab has a bore into said tab, and wherein said proximal end of said shaft is inserted into said bore of said tab; and wherein said tab has thickened region about said bore, said thickened region of said tab having a first portion outwardly extending from one of said faces of said tab and a second portion outwardly extending from the other face of said tab.

2. The tool of claim 1, wherein said shaft has a longitudinal axis extending between said proximal and distal ends of said shaft, said shaft having a generally circular transverse cross section taken in a plane substantially perpendicular to said longitudinal axis of said shaft.

3. The tool of claim 1, wherein said shaft tapers from said proximal end of said shaft to said distal end of said shaft such that a diameter of said shaft is greater at said proximal end of said shaft than at said distal end of said shaft.

4. The tool of claim 1, wherein said bore is located opposite said straight edge of said tab.

5. The tool of claim 1, further comprising a pin being extended into said thickened region of said tab through said bore of said tab and a portion of said shaft inserted into said bore of said tab.

6. The tool of claim 1, wherein said hook of said shaft lies in a plane extending generally parallel to said faces of said tab.

7. The tool of claim 1, wherein said tab has a magnet coupled thereto.

8. A tool for removing packing cotton from a container, said tool comprising:

an elongate shaft having opposite proximal and distal ends, and a longitudinal axis extending between said proximal and distal ends of said shaft;

said shaft having a generally circular transverse cross section taken in a plane substantially perpendicular to said longitudinal axis of said shaft;

said shaft having a length defined between said ends of said shaft and a diameter defined substantially perpendicular to said longitudinal axis of said shaft;

said shaft tapering from said proximal end of said shaft to said distal end of said shaft such that said diameter of said shaft is greater at said proximal end of said shaft than at said distal end of said shaft;

said shaft having a hook at said distal end of said shaft, said hook having a pointed tip;

a tab having a pair of substantially planar faces, and an outer perimeter comprising an arcuate edge and a straight edge;

said arcuate edge of said tab defining an arc greater than an arc defined by a semi-circle and less than an arc defined by a full circle;

said arcuate edge of said tab having a generally cylindrical bore into said tab located opposite said straight edge of said tab;

said bore of said tab having an axis extending substantially perpendicular to said straight edge of said tab;

said tab having a generally cylindrical thickened region about said bore, said thickened region of said tab having a generally semi-cylindrical first portion outwardly extending from one of said faces of said tab and a generally semi-cylindrical second portion outwardly extending from the other face of said tab;

said thickened region of said tab having a rounded end opposite said arcuate edge of said tab;

said proximal end of said shaft being inserted into said bore of said tab such that said distal end of said shaft outwardly extends away from said arcuate edge of said tab;

said longitudinal axis of said shaft being extended substantially perpendicular to said straight edge of said tab;

said hook of said shaft lying in a plane extending generally parallel to said faces of said tab;

a pin being extended into said thickened region of said tab through said bore of said tab and a portion of said shaft inserted into said bore of said tab, said pin having a longitudinal axis extending substantially perpendicular to said longitudinal axis of said shaft;

said pin securing said proximal end of said shaft in said bore of said tab; and said tab having a magnet coupled to one of said faces of said tab between said rounded end of said thickened region and said straight edge.

* * * * *